US007090023B2

(12) United States Patent
Haugen et al.

(10) Patent No.: US 7,090,023 B2
(45) **Date of Patent: *Aug. 15, 2006**

(54) APPARATUS AND METHODS FOR DRILLING WITH CASING

(75) Inventors: David M. Haugen, League City, TX (US); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/124,755

(22) Filed: May 9, 2005

(65) Prior Publication Data

US 2005/0205250 A1 Sep. 22, 2005

Related U.S. Application Data

(62) Division of application No. 10/269,661, filed on Oct. 11, 2002, now Pat. No. 6,896,075.

(51) Int. Cl.
*E21B 7/20* (2006.01)

(52) U.S. Cl. ..... 166/381; 166/105; 175/324

(58) Field of Classification Search ..... 166/105, 166/381; 175/324, 100, 102
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |

(Continued)

FOREIGN PATENT DOCUMENTS

| | | |
|---|---|---|
| CA | 2 335 192 | 11/2001 |

(Continued)

OTHER PUBLICATIONS

M.B. Stone and J. Smith, "Expandable Tubulars and Casing Drilling are Options" Drilling Contractor, Jan./Feb. 2002, pp. 52.

(Continued)

*Primary Examiner*—Hoang Dang
(74) *Attorney, Agent, or Firm*—Patterson & Sheridan

(57) ABSTRACT

The present invention provides an apparatus and methods to reduce ECD and pressure associated therewith while drilling with casing. In one aspect, the invention provides an energy transfer assembly locatable at a predetermined location in a casing string. The assembly includes an impeller portion in the interior of the casing to be acted upon by the downward moving fluid in the casing and a pump portion disposed outwardly of the impeller portion and arranged in fluid communication with the upward moving fluid in the annulus between the casing and the borehole, adding energy thereto and reducing pressure in the annulus therebelow. In another aspect, the energy transfer assembly is retrievable to the surface of the wellbore prior to cementing. In a further aspect, fluid ports between the interior and exterior of the casing are remotely sealable prior to cementing.

33 Claims, 9 Drawing Sheets

U.S. PATENT DOCUMENTS

| | | | |
|---|---|---|---|
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church, et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,658,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,747,675 | A | 7/1973 | Brown |
| 3,748,330 | A | 7/1973 | Taciuk |
| 3,760,894 | A | 9/1973 | Pitifer |
| 3,766,991 | A | 10/1973 | Brown |
| 3,776,320 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,063,602 | A | 12/1977 | Howell et al. |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |
| 4,194,383 | A | 3/1980 | Huzyak |
| 4,221,269 | A | 9/1980 | Hudson |
| 4,227,197 | A | 10/1980 | Nimmo et al. |
| 4,241,878 | A | 12/1980 | Underwood |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,277,197 | A | 7/1981 | Bingham |
| 4,280,380 | A | 7/1981 | Eshghy |
| 4,281,722 | A | 8/1981 | Tucker et al. |
| 4,287,949 | A | 9/1981 | Lindsey, Jr. |
| 4,291,772 | A | 9/1981 | Beynet |
| 4,311,195 | A | 1/1982 | Mullins, II |

4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,430,892 A 2/1984 Owings
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,531,593 A * 7/1985 Elliott et al. ..... 175/71
4,534,426 A 8/1985 Hooper
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,832,891 A 5/1989 Kass
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,205,365 A 4/1993 Quintana
5,224,540 A 7/1993 Streich et al.
5,233,742 A 8/1993 Gray et al.
5,234,052 A 8/1993 Coone et al.
5,245,265 A 9/1993 Clay 5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,339,899 A 8/1994 Ravi et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,546,317 A 8/1996 Andrieu
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A * 3/1997 Wood ..... 166/68
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.

6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McCleod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,257,333 B1 7/2001 Mann et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Galloway et al.
6,719,071 B1 4/2004 Moyes
6,725,924 B1 4/2004 Davidson et al.
6,725,938 B1 4/2004 Pietras
6,729,533 B1 5/2004 Galloway et al.
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,776,233 B1 8/2004 Meehan
6,832,656 B1 12/2004 Fournier, Jr. et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
6,868,906 B1 3/2005 Vail
6,877,553 B1 4/2005 Cameron
6,889,772 B1 5/2005 Buytaert et al.
6,892,835 B1 5/2005 Shahin et al.
6,896,075 B1 5/2005 Haugen et al.
6,899,186 B1 5/2005 Galloway et al.
2001/0042625 A1 11/2001 Appleton
2002/0040787 A1 4/2002 Cook et al.
2002/0066556 A1 6/2002 Goode et al.
2002/0108748 A1 8/2002 Keyes
2002/0170720 A1 11/2002 Haugen

| | | | |
|---|---|---|---|
| 2002/0189863 | A1 | 12/2002 | Wardley |
| 2003/0029641 | A1 | 2/2003 | Meehan |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0217865 | A1 | 11/2003 | Simpson et al. |
| 2003/0221519 | A1 | 12/2003 | Haugen et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0031622 | A1 | 2/2004 | Butler et al. |
| 2004/0060697 | A1 | 4/2004 | Tilton et al. |
| 2004/0069501 | A1 | 4/2004 | Haugen et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118614 | A1 | 6/2004 | Galloway et al. |
| 2004/0118813 | A1 | 6/2004 | Vail |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux |
| 2004/0216924 | A1 | 11/2004 | Pietras |
| 2004/0216925 | A1 | 11/2004 | Metcalfe et al. |
| 2004/0221997 | A1 | 11/2004 | Giroux |
| 2004/0226751 | A1 | 11/2004 | McKay |
| 2004/0244992 | A1 | 12/2004 | Carter |
| 2004/0245020 | A1 | 12/2004 | Giroux |
| 2004/0251025 | A1 | 12/2004 | Giroux |
| 2004/0251050 | A1 | 12/2004 | Shahin |
| 2004/0251055 | A1 | 12/2004 | Shahin |
| 2004/0262013 | A1 | 12/2004 | Tilton |
| 2005/0000691 | A1 | 1/2005 | Giroux et al. |
| 2005/0096846 | A1 | 5/2005 | Koithan et al. |

FOREIGN PATENT DOCUMENTS

| | | |
|---|---|---|
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 571 045 | 11/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 2/1973 |
| GB | 1 308 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 0 389 130 | 12/2003 |
| GB | 2 389 130 | 12/2003 |
| RU | 1618870 | 1/1991 |
| SU | 112631 | 1/1956 |
| SU | 695260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1808972 | 5/1991 |
| WO | WO 90-06418 | 6/1990 |
| WO | WO 91-16520 | 10/1991 |
| WO | WO 92-01139 | 1/1992 |
| WO | WO 92-18743 | 10/1992 |
| WO | WO 92-20899 | 11/1992 |
| WO | WO 93-07358 | 4/1993 |

| | | |
|---|---|---|
| WO | WO 93-24728 | 12/1993 |
| WO | WO 95-10686 | 4/1995 |
| WO | WO 96-18799 | 6/1996 |
| WO | WO 96-28635 | 9/1996 |
| WO | WO 97-05360 | 2/1997 |
| WO | WO 97-08418 | 3/1997 |
| WO | WO 98/01651 | 1/1998 |
| WO | WO 98-05844 | 2/1998 |
| WO | WO 98-09053 | 3/1998 |
| WO | WO 98-11322 | 3/1998 |
| WO | WO 98-32948 | 7/1998 |
| WO | WO 98-55730 | 12/1998 |
| WO | WO 99-04135 | 1/1999 |
| WO | WO 99-11902 | 3/1999 |
| WO | WO 99-23354 | 5/1999 |
| WO | WO 99-24689 | 5/1999 |
| WO | WO 00-37881 | 7/1999 |
| WO | WO 99-35368 | 7/1999 |
| WO | WO 99-41485 | 8/1999 |
| WO | WO 99-50528 | 10/1999 |
| WO | WO 99-58810 | 11/1999 |
| WO | WO 99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00/41487 | 7/2000 |
| WO | WO 00-46484 | 8/2000 |
| WO | WO 00-50730 | 8/2000 |
| WO | WO 00-50731 | 8/2000 |
| WO | WO 00-66879 | 11/2000 |
| WO | WO 01-12946 | 2/2001 |
| WO | WO 01-46550 | 6/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 00-04269 | 2/2002 |
| WO | WO 02/14649 | 2/2002 |
| WO | WO 02-14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |

OTHER PUBLICATIONS

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Costs By 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPE/IADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling," World Oil, Sep. 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000, pp. 1-11.

Warren, et al., "Drilling Technology: Part I—Casing Drilling With Directional Steering In The U.S. Gulf Of Mexico," Offshore, Jan. 2001, pp. 50-52.

Warren, et al., "Drilling Technology: Part II—Casing Drilling With Directional Steering In The Gulf Of Mexico," Offshore, Feb. 2001, pp. 40-42.

Shepard, et al., "Casing Drilling: An Emerging Technology," IADC/SPE Paper 67731, SPE/IADC Drilling Conference, Feb. 27-Mar. 1, 2001, pp. 1-13.

Editor, "Tesco Finishes Field Trial Program," Drilling Contractor, Mar./Apr. 2001, p. 53.

Warren, et al., "Casing Drilling Technology Moves To More Challenging Application," AADE Paper 01-NC-HO-32, AADE National Drilling Conference, Mar. 27-29, 2001, pp. 1-10.

Shephard, et al., "Casing Drilling: An Emerging Technology," SPE Drilling & Completion, Mar. 2002, pp. 4-14.

Shephard, et al., "Casing Drilling Successfully Applied in Southern Wyoming," World Oil, Jun. 2002, pp. 33-41.

Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.

World's First Drilling With Casing Operation From A Floating Drilling Unit, Sep. 2003, 1 page.

Filippov, et al., "Expandable Tubular Solutions," SPE paper 56500, SPE Annual Technical Conference And Exhibition, Oct. 3-6, 1999, pp. 1-16.

Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-8, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
PCT Search Report, Application No. GB 0323983.7, dated Dec. 19, 2003.
U.S. Appl. No. 10/189,570, filed Jun. 6, 2002 (WEAT/0411).
U.S. Appl. No. 10/618,093, filed Jul. 11, 2003 (WEAT/0403).
Hahn, et al., "Simultaneous Drill and Case Technology—Case Histories, Status and Options for Futher Development," Society of Petroleum Engineers, IADC/SPE Drilling Conference, New Orlean, LA Feb. 23-25, 2000 pp. 1-9.
Detlef Hahn, Friedhelm Makohl and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Canadian Office Action, Application No. 2,444,555, dated Nov. 30, 2005.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparision of Performance of Horizontal Wells in Bouri Field, SPE 26927, Society of Petroleum Engineers, Inc. 1998.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Niaquin, Rudy Cardenas, Lev M. Ring, Patrick L. York, Expandable Tubulars: Field Examples of Application in Well Construction and Remediation, SPE 62958, Society of Petroleum Engineers, Inc., 2000.
C. Lee Lohoefer, Ben Mathis, David Brisco, Kevin Waddell, Lev Ring, and Patrick York, Expandable Linear Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Diagle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.

* cited by examiner

APPARATUS AND METHODS FOR DRILLING WITH CASING

CROSS-REFERENCE TO RELATED APPLICATIONS

This application is a divisional of application Ser. No. 10/269,661, filed Oct. 11, 2002, now U.S. Pat. No. 6,896,075. The aforementioned related patent application is herein incorporated by reference in its entirety.

BACKGROUND OF THE INVENTION

FIELD OF THE INVENTION

The present invention relates to the reduction of equivalent circulation density (ECD) in a wellbore. More particularly, the invention relates to the reduction of ECD in a wellbore that is formed while inserting a tubular string that will remain in place in the wellbore as a liner or a casing string. More particularly still, the invention relates to an apparatus and methods to reduce ECD in a wellbore as it is drilled with casing.

In the formation of oil and gas wells a borehole is formed in the earth with a drill bit typically mounted at the end of a string of relatively small diameter tubing or drill string. To facilitate the drilling, fluid is circulated through the drill string, out the bit and upward in an annular area between the drill string and the wall of the borehole. The fluid cools the bit and helps remove cuttings. After a predetermined length of borehole is formed, the bit and drill string are removed from the well and larger diameter string called casing or liner is inserted to form the wellbore. The casing is used to line the borehole walls and the annular area between the outer surface of the casing and the borehole is filled with cement to help strengthen the wellbore and aid in isolating sections of the wellbore for hydrocarbon production. In this specification, the terms "borehole" and "well bore" are used interchangeably and the terms "casing" and "liner" are used interchangeably and relate to a tubular string used to line the walls of a borehole.

The length of borehole formed before it is lined with casing depends largely on pressure developed towards the lower end of the borehole as it is drilled. Because the wellbore is filled with fluid while drilling, a hydrostatic head of pressure is always present and increases with the increased depth of the borehole. Adding to the hydrostatic head is a friction head created by the circulation of the fluid. The combination of hydrostatic and friction heads produces the equivalent circulation density of the fluid. The pressure created by ECD is useful while drilling because it can exceed the pore pressure of formations intersected by the borehole and prevent hydrocarbons from entering the wellbore. However, increased depth of a section of borehole can cause the ECD to exceed a fracture pressure of the formations, forcing the wellbore fluid into the formations and hampering the flow of hydrocarbons into the wellbore after the well is completed. In wells that are drilled in an underbalanced condition, ECD can cause the pressure in the borehole to exceed the pore pressure of the wellbore, making the well over-balanced.

In order to reduce the pressure created by ECD and to increase the length of borehole that can be formed before running in with casing, ECD reduction devices have been used which are designed to be run on drill string and reduce the ECD by adding energy to drilling fluid in the annulus between the drill string and the borehole. Examples include devices that redirect some of the fluid from the drill string out into the annulus and others that have some type of pumping means to add energy to the returning fluid in the annulus. In each instance, the goal is to reduce the effective pressure of the fluid near the bottom of the borehole so that a section of borehole drilled without stopping to run casing can be maximized. An ECD reduction tool and methods for its use is described in co-pending U.S. application Ser. No. 10/156,722 and that specification, filed May 28, 2002 is incorporated herein in its entirety. Additional examples of ECD tools are discussed in Publication No. PCT/GB00/00642 and that publication is also incorporated herein by reference it its entirety.

Drilling with casing is a method of forming a borehole with a drill bit attached to the same string of tubulars that will line the borehole. In other words, rather than run a drill bit on smaller diameter drill string, the bit is run at the end of larger diameter tubing or casing that will remain in the wellbore and be cemented therein. The advantages of drilling with casing are obvious. Because the same string of tubulars transports the bit as lines the borehole, no separate trip into the wellbore is necessary between the forming of the borehole and the lining of the borehole. Drilling with casing is especially useful in certain situations where an operator wants to drill and line a borehole as quickly as possible to minimize the time the borehole remains unlined and subject to collapse or the effects of pressure anomalies. For example, when forming a sub-sea borehole, the initial length of borehole extending from the ocean floor is much more subject to cave in or collapse as the subsequent sections of borehole. Sections of a borehole that intersect areas of high pressure can lead to damage of the borehole between the time the borehole is formed and when it is lined. An area of exceptionally low pressure will drain expensive drilling fluid from the wellbore between the time it is intersected and when the borehole is lined. In each of these instances, the problems can be eliminated or their effects reduced by drilling with casing. Various methods and apparatus for drilling with casing are disclosed in co-pending application Ser. No. 09/848,900 filed May 4, 2001 and that specification is incorporated herein in its entirety.

The challenges and problems associated with drilling with casing are as obvious as the advantages. For example, the string of casing must fit within any preexisting casing already in the well bore. Because a string of casing transporting the drill bit is left to line the borehole, there is no opportunity to retrieve the bit in the conventional manner. Drill bits made of drillable material, two-piece drill bits and bits integrally formed at the end of casing string have been used to overcome the problems. For example, a two-piece bit has an outer portion with a diameter exceeding the diameter of the casing string. When the borehole is formed, the outer portion is disconnected from an inner portion that can be retrieved to the surface of the well. Typically, a mud motor is used near the end of the liner string to rotate the bit as the connection between the pieces of casing are not designed to withstand the tortuous forces associated with rotary drilling. In this manner, the casing string can be rotated at a moderate speed at the surface as it is inserted and the bit rotates at a much faster speed due to the fluid-powered mud motor.

Equivalent circulating density is as big a factor when drilling with casing as when drilling with conventional drill string because fluid must still be circulated while the borehole is being formed. Because the diameter of the casing is so near the internal diameter of the borehole, conventional ECD reduction techniques are problematic. For example, using a fluid powered pump to add energy to the returning fluid in the annulus between the casing and the borehole is more challenging because there is so little space in the annulus for the blades of a pump. More problematic, any fluid pump/impeller device must operate in the interior of the casing string and the interior of the casing string must be left free of obstruction prior to cementing. Additionally, redirecting fluid from the interior to the exterior of the casing to reduce ECD necessarily requires a fluid path between the interior and exterior of the casing. However, the casing string, to be properly cemented in place must be free of fluid paths between its interior and exterior.

There is a need therefore for a method and apparatus that permits drilling with casing while reducing ECD developed during the drilling process. There is a further need for a method and an apparatus of drilling with casing that leaves the interior of the casing free of obstruction after the borehole is formed. There is yet a further need for a method and apparatus that leaves the walls of the casing ready for cementing after the borehole is formed.

SUMMARY OF THE INVENTION

The present invention provides an apparatus and methods to reduce ECD and pressure associated therewith while drilling with casing. In one aspect, the invention provides an energy transfer assembly locatable at a predetermined location in a casing string. The assembly includes an impeller portion in the interior of the casing to be acted upon by the downward moving fluid in the casing and a pump portion disposed outwardly of the impeller portion and arranged in fluid communication with the upward moving fluid in the annulus between the casing and the borehole, adding energy thereto and reducing pressure therebelow. In another aspect, the energy transfer assembly is retrievable to the surface of the wellbore prior to cementing. In a further aspect, fluid ports between the interior and exterior of the casing are remotely sealable prior to cementing.

DETAILED DESCRIPTION OF THE PREFERRED EMBODIMENT

Figure 1:
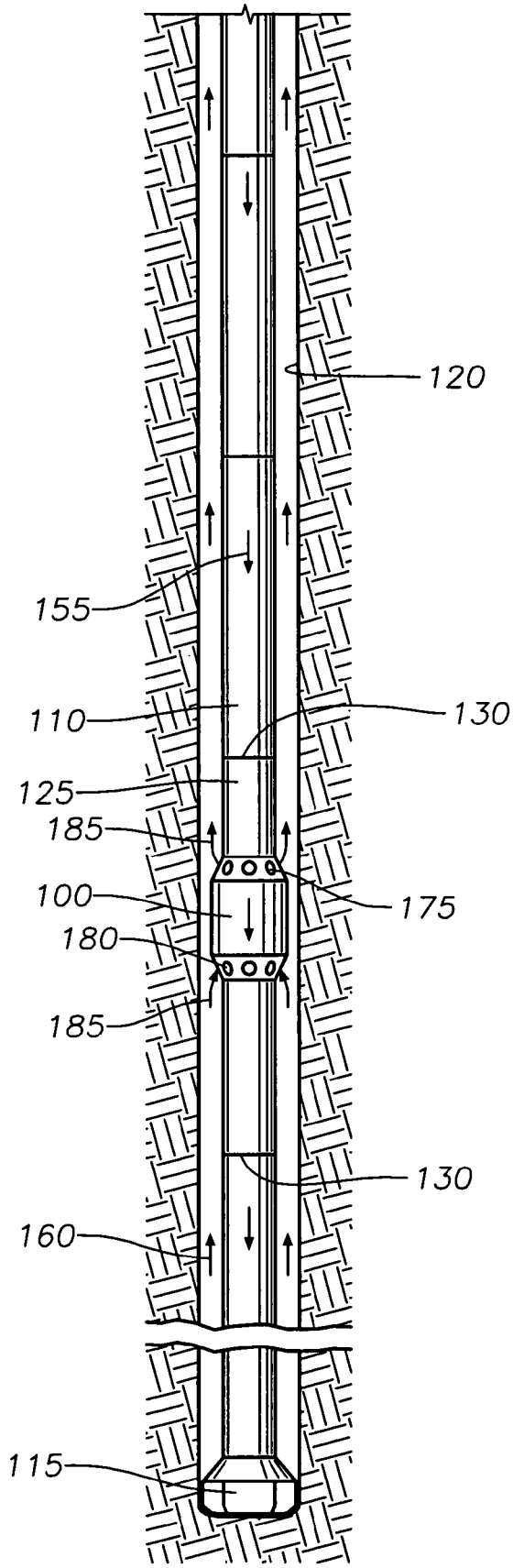
FIG. 1 is a partial section view of a section of casing in a wellbore, the casing having an energy transfer assembly of the present invention disposed therein.

FIG. 1 is a partial section view showing an energy transfer assembly 100 of the present invention disposed in a casing string 110 that is used to transport a drill bit 115 and form a borehole 120. As illustrated, the assembly 100 is typically housed in a sub 125 or separate section of the casing that can be inserted between standard pieces of casing as the casing is run into the well. There are typically threaded connection means 130 at each end of the sub to facilitate connections of the casing. In FIG. 1, the assembly 100 is illustrated at some position in the casing string above the drill bit. In fact, the assembly can be placed at any location in the string depending upon the needs of an operator and multiple assemblies 100 can also be spaced along the string. Illustrated by arrows 155, fluid is pumped downwards through the casing as the borehole is formed and is circulated back to the surface of the well in an annulus as shown by arrows 185. As will be explored in further detail, the energy transfer assembly is operated by the fluid 155 flowing downwards in the casing 110.

Figure 2A:
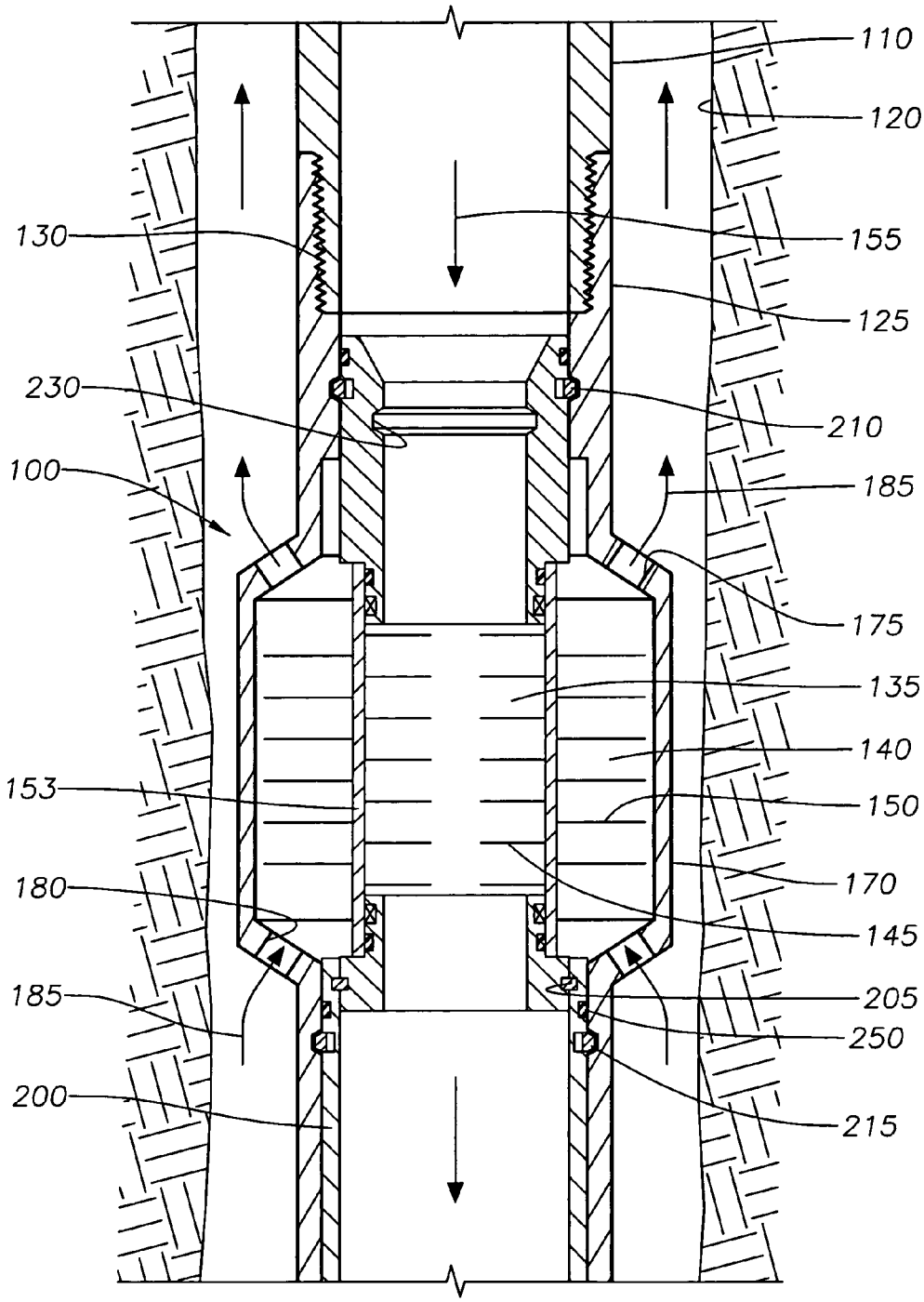
FIGS. 2A and 2B are enlarged views of the energy transfer assembly and its operation.
Figure 2B:
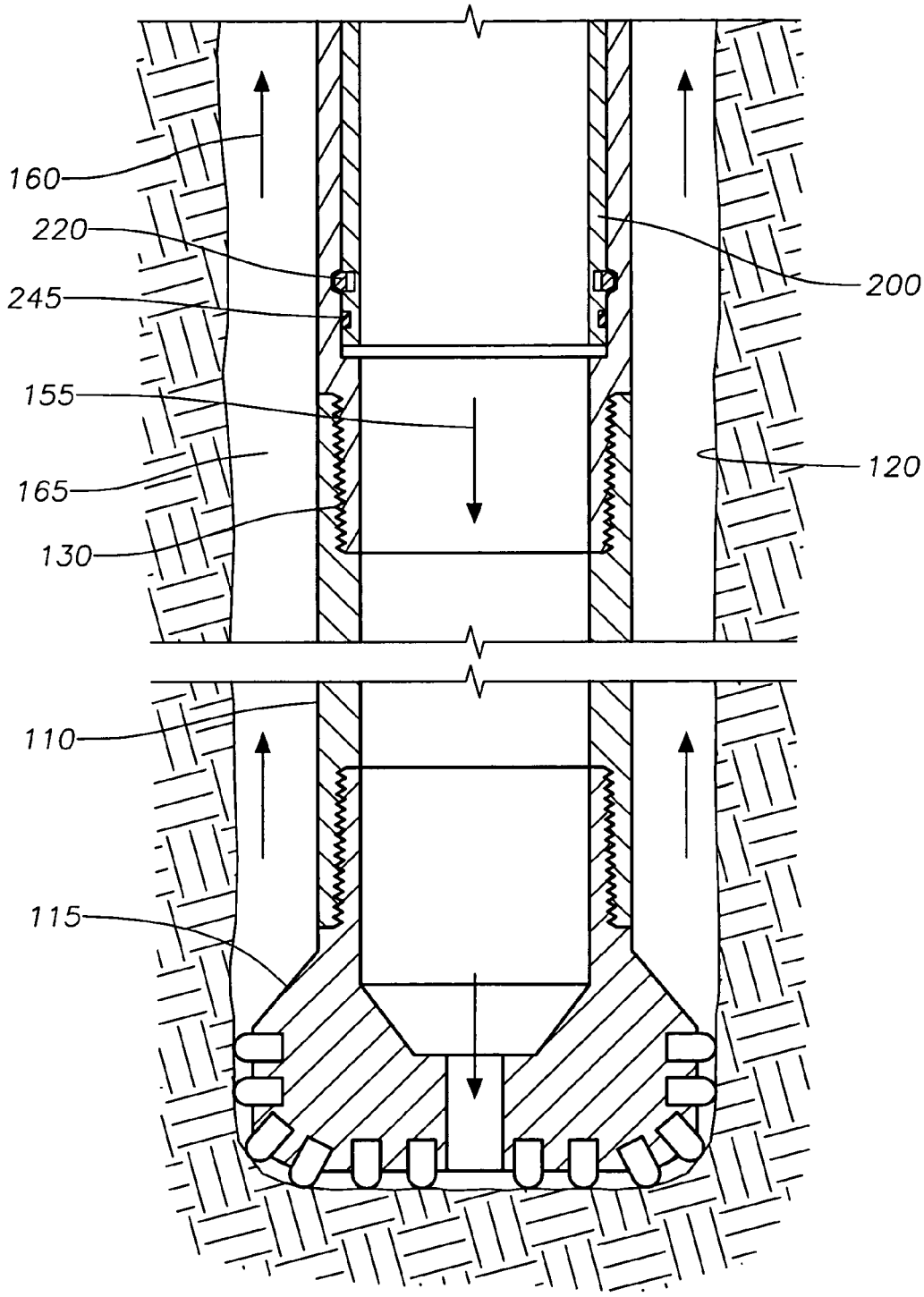

FIG. 2 is a section view showing the energy transfer assembly 100 in greater detail. In one embodiment, the device includes an annular impeller portion 135 and an annular pump portion 140. The impeller portion includes a number of inwardly facing donut-shaped impeller blades 145 that are constructed and arranged to be acted upon by fluid as it travels downward through the casing during drilling. More specifically, the impeller blades are caused to rotate as the fluid moves from one to the next. The principle of the impeller and its use to generate a force is well known to those skilled in the art. Disposed outwards of the impeller portion 135 are a similar number of pumping blades 150. The impeller and pump blades are isolated from each other by body member 153. The pumping blades are designed to rotate with the force created by downwardly flowing fluid 155 upon the impeller blades and to add that force or energy to fluid passing upwards 160 in the annulus 165 of the wellbore. In this manner, ECD or pressure upon the walls of the borehole is reduced near and below the energy transfer device 100.

In addition to protecting an adjacent formation from fracture due to ECD forces, the energy transfer device is also useful to facilitate the insertion of a casing string by reducing the effects of frictional forces encountered as the relatively large diameter casing moves through the newly created borehole.

As shown in FIG. 2, the assembly 100 includes an annularly shaped pocket 170 extending outward from the center of the body to the assembly in the area of the impeller and pump blades. The pocket 170 generally houses the pumping blades 150. At upper and lower ends of the pocket are ports 175, 180 permitting fluid to pass into and out of the energy transfer assembly as illustrated by the arrows 185. In a preferred embodiment, the assembly as designed whereby the pump urges fluid into the lower port 180 and the fluid is then expelled with added energy through the upper port 175. Both the impeller and pump blades can be sized and numbered to create a desired effect according to well conditions and needs of an operator. The ports may also be distributed circumferentially around the upper and lower ends of the pocket 170 to determine the amount of wellbore fluid entering the device from the annulus 165. Also visible in FIG. 2 is a sleeve 200 attached to a lower end of the impeller/pump portion by a shearable member 205. The sleeve permits the ports 175, 180 in the pocket to be sealed prior to cementing as will be explained herein.

FIG. 2 also illustrates aspects of the assembly 100 that permit its retrievability prior to cementing of the casing in the borehole. The assembly is shown in the run-in position with the annular impeller 135 and pump 140 portions disposed in the interior of the sub 125 adjacent the pocket 170. The assembly is held in position by a latch 210 at an upper end that fits within a profile formed in the interior of the sub housing 125. Another latch arrangement 215 exists between an upper end of the sleeve 200 and the interior wall of the sub and a third latch 220 arrangement retains the sleeve 200 at a lower end thereof. In the run-in and operating positions, the latches retain the assembly in the housing as shown in FIG. 2. After the drilling is complete and the casing is ready to be submitted in the wellbore, the assembly 100 may be retrieved from the wellbore by using well-known techniques and tools that are insertable into the wellbore and matable with an inwardly extending profile 230 formed in an upper end of the assembly 100.

In order to retrieve the assembly 100, a removal tool (not shown) with a mating profile to the profile 230 formed at the upper end of the assembly is run into the well and latched to the assembly. Upon the application of a predetermined upward force, the three latches 210, 215, 220 are overcome and the assembly moves upward to the position shown in FIG. 3. Specifically, the second latch 215 assumes the position within the first profile and the third latch assumes a position within the second profile. In this position, the sleeve 200 covers the pocket 170 and seal members 245, 250 at an upper and lower end of the sleeve 200 provide a pressure-tight seal between the sleeve and the body of the sub 125. The pump blades 150 are preferably formed of some stiff but flexible material permitting them to fold downwards as they encounter the wall of the housing as the assembly moves upwards in the sub 125.

Figure 3:
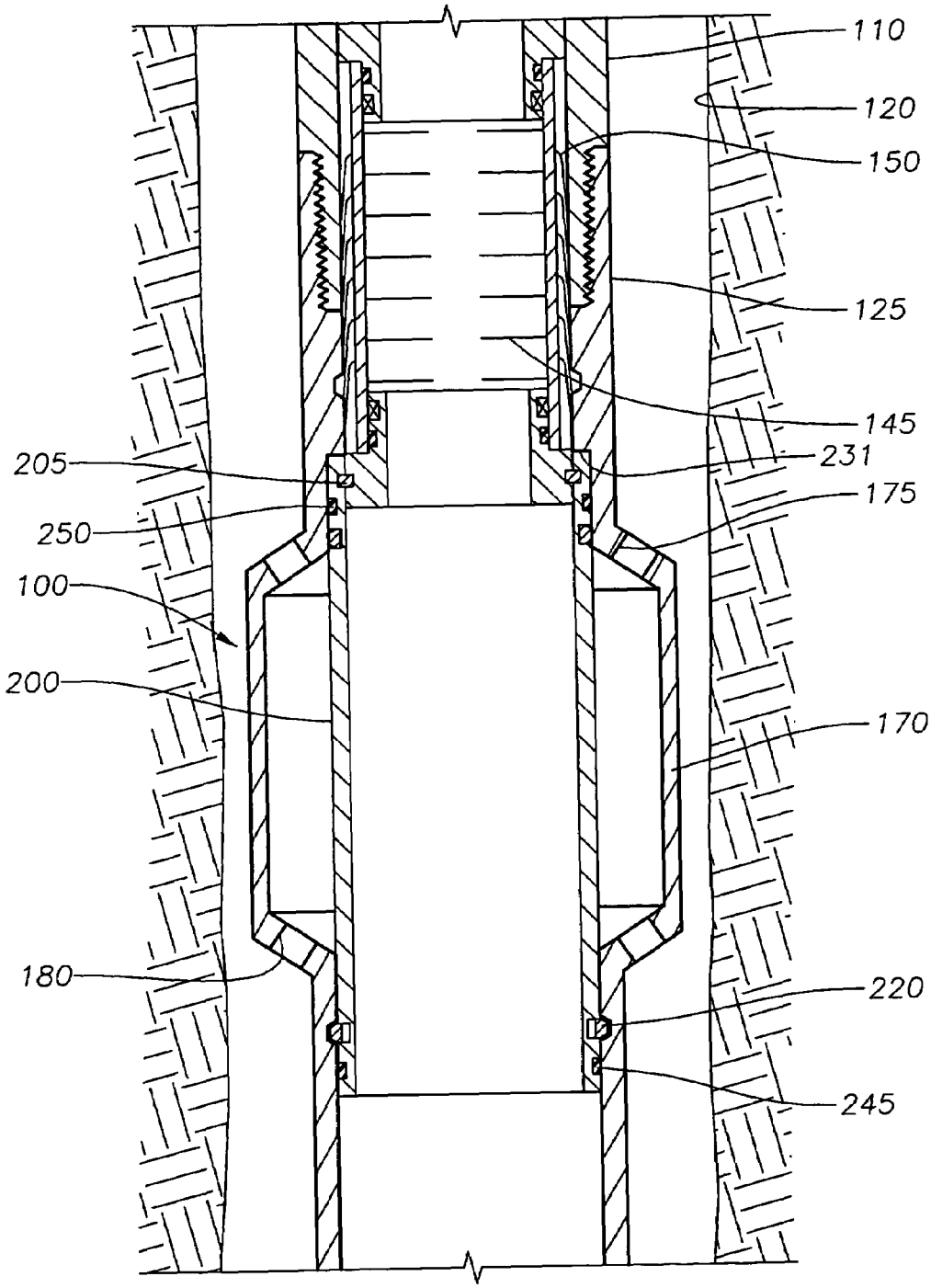
FIG. 3 is a section view of the assembly as it is being retrieved to the surface of the well.

FIG. 3 is a section view showing the assembly 100 after it has been partially removed from the well. FIG. 3 illustrates the sleeve 200 in a position whereby it seals ports 180, 175. In order to complete the retrieval, the shearable connection 205 between the sleeve 200 and the impeller/pump portion is caused to fail by force applied thereto. Preferably, the sleeve "shoulders out" as illustrated at its upper end into a shoulder 231 formed in the interior of the sub 125. In this manner, the sleeve can remain in the interior of the sub without substantially reducing the inside diameter of the casing.

Figure 4:
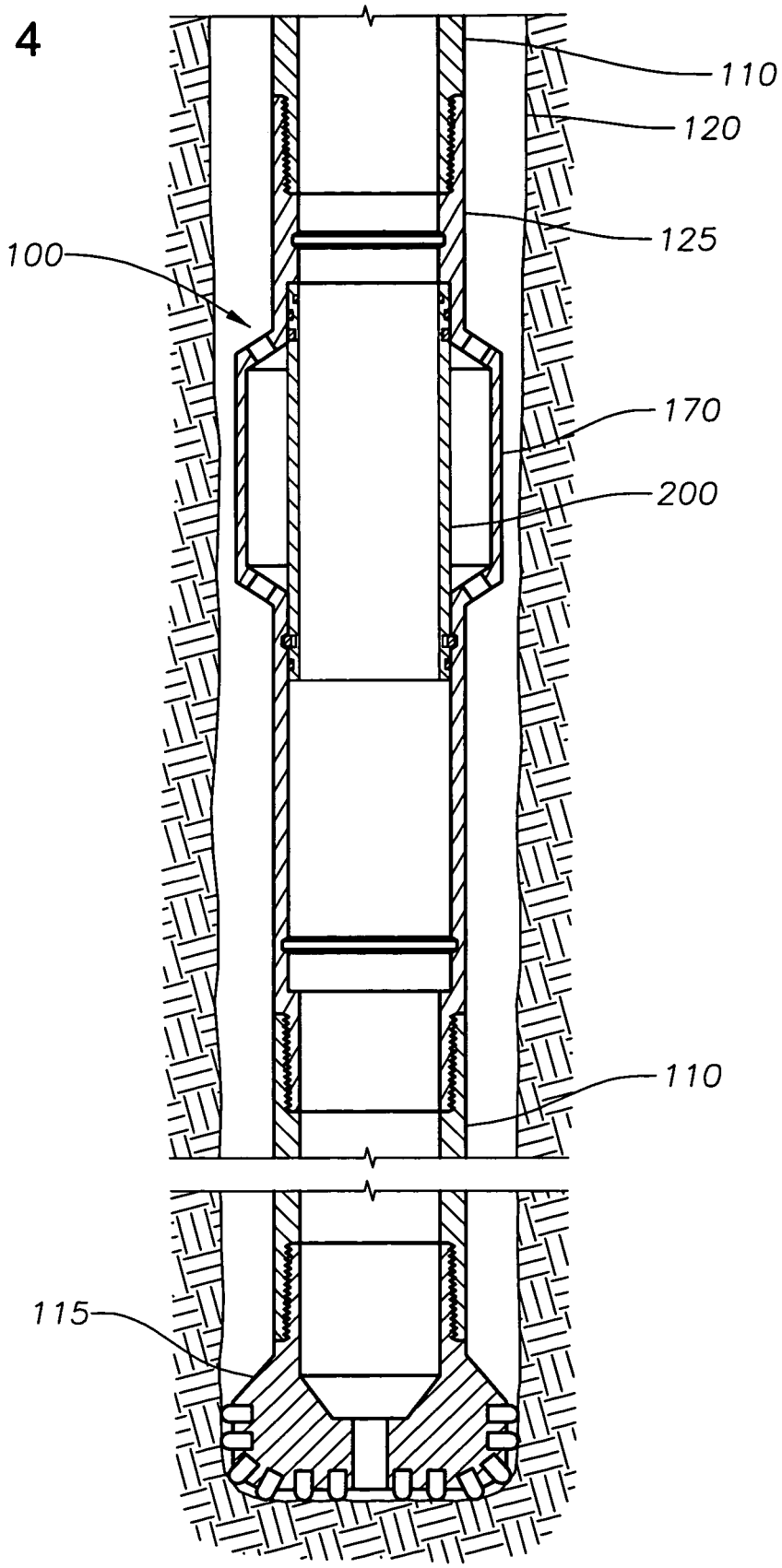
FIG. 4 is a section view showing a sleeve disposed across fluid ports in the casing prior to cementing.
Figure 5A:
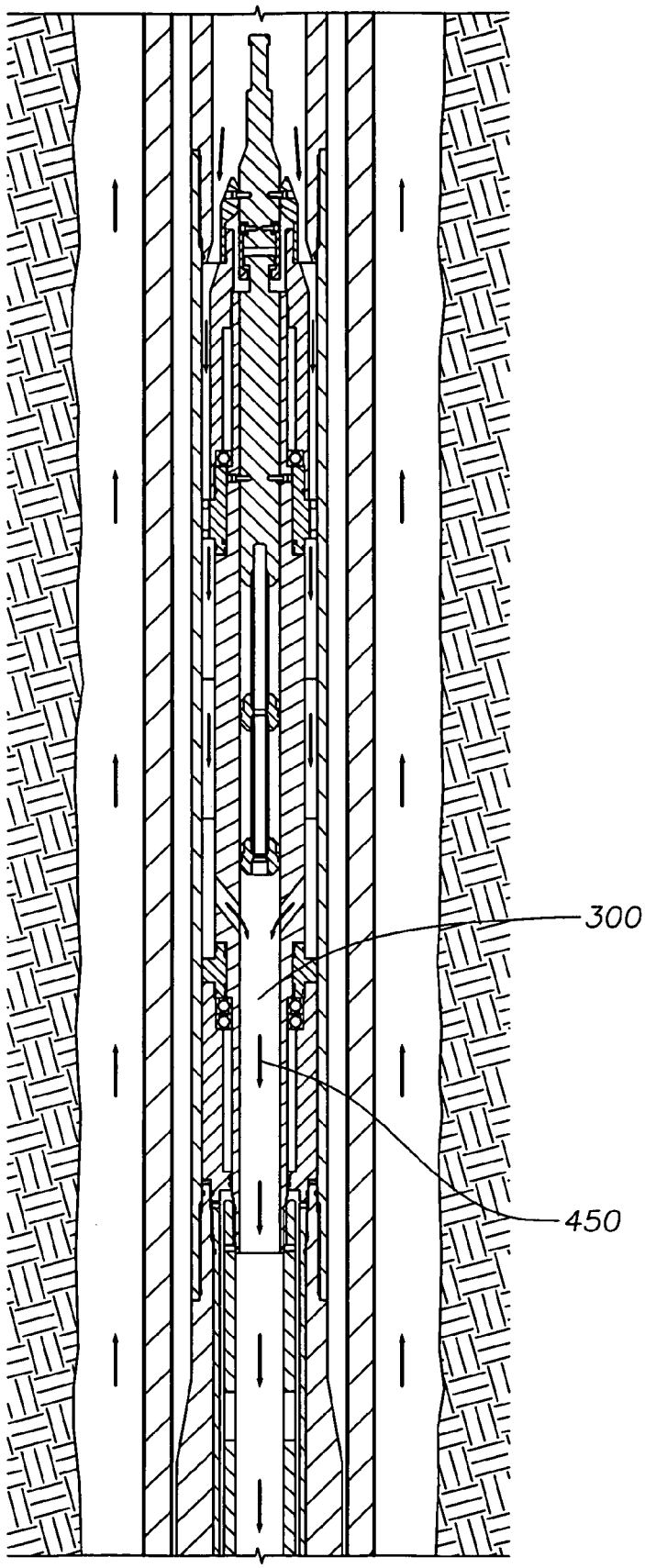
FIGS. 5A–5D are a section view of an alternative embodiment of the invention including a pump and motor housed in a casing string and removable therefrom.
Figure 5B:
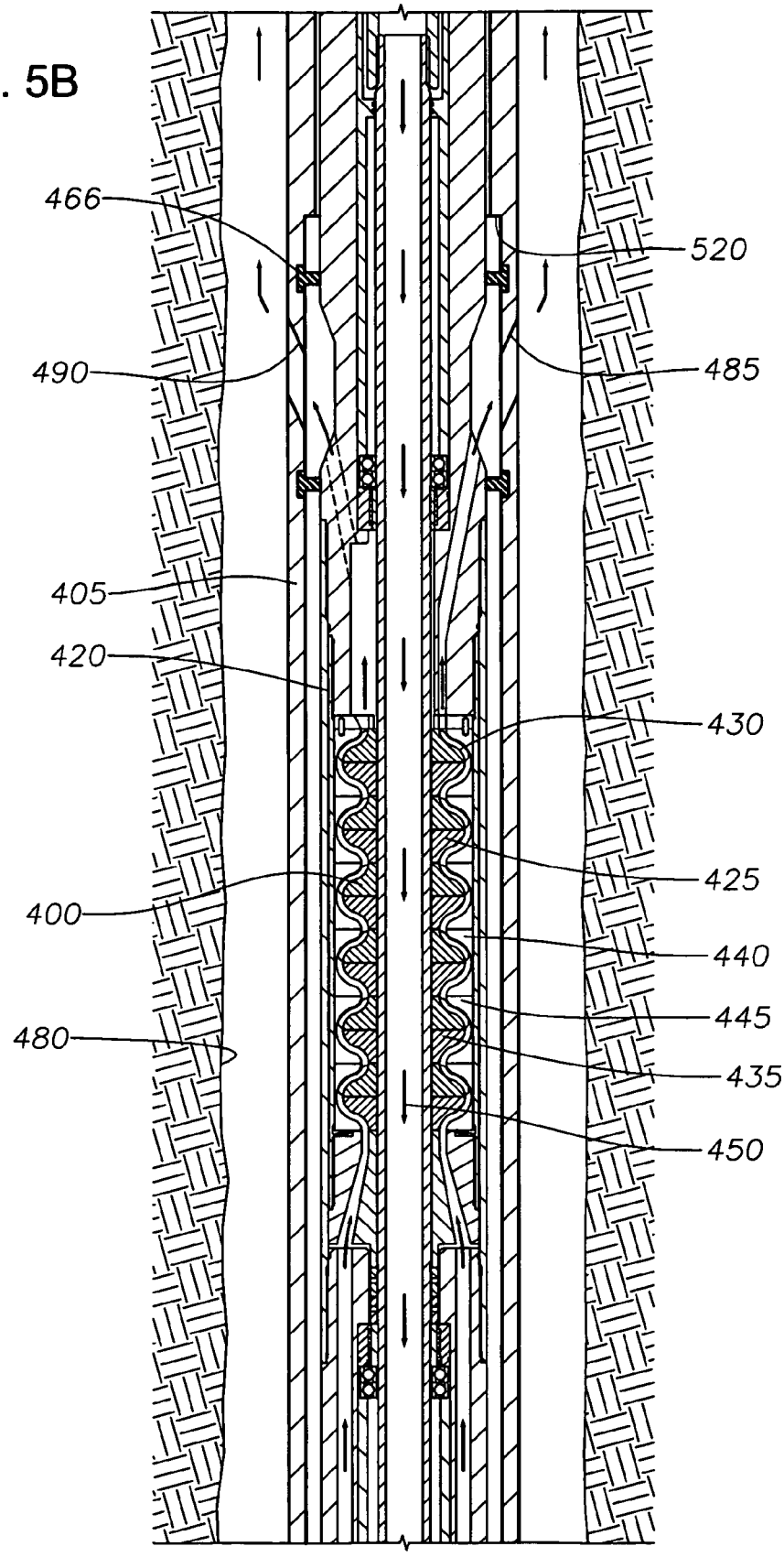
Figure 5C:
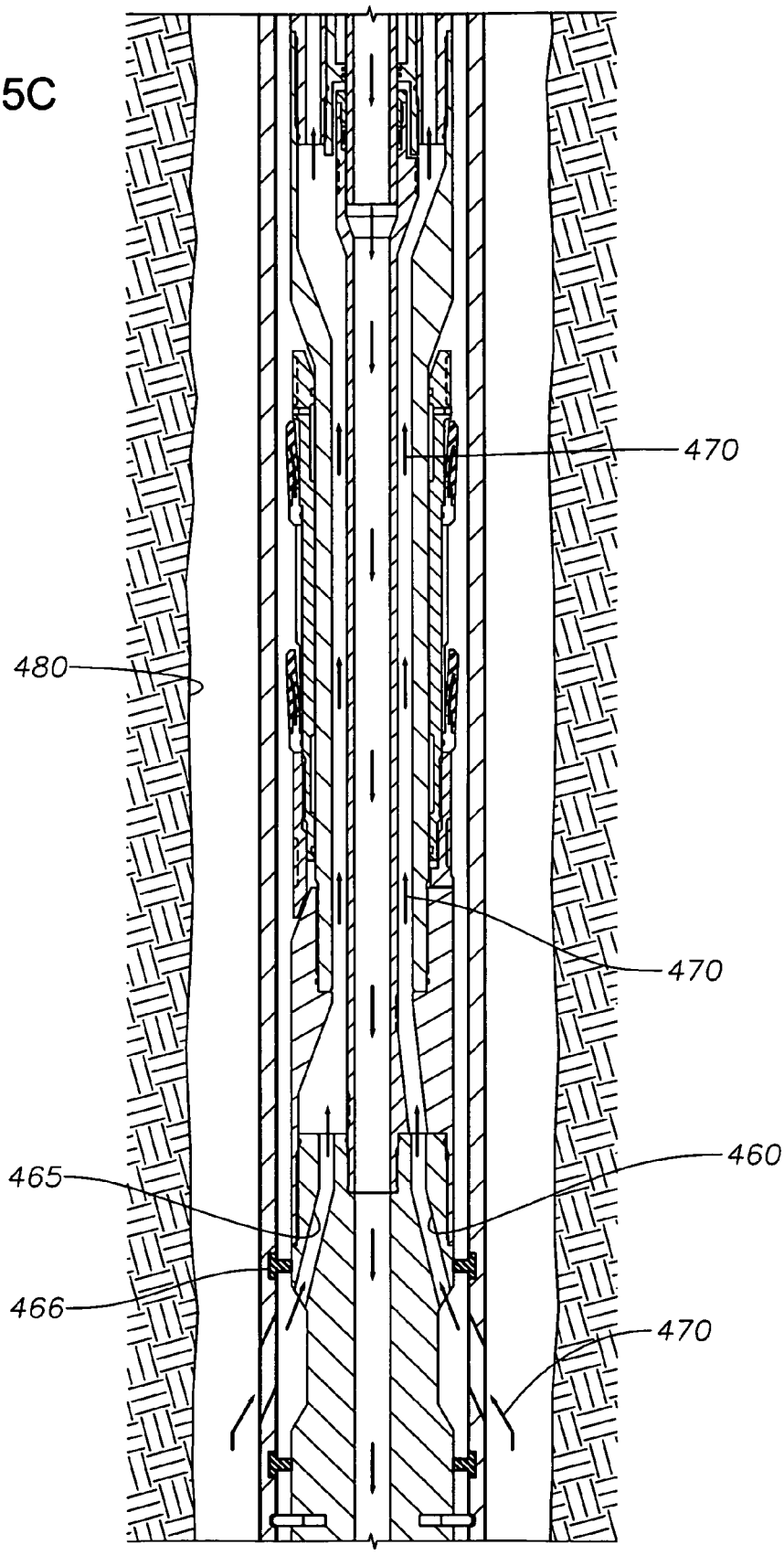
Figure 5D:
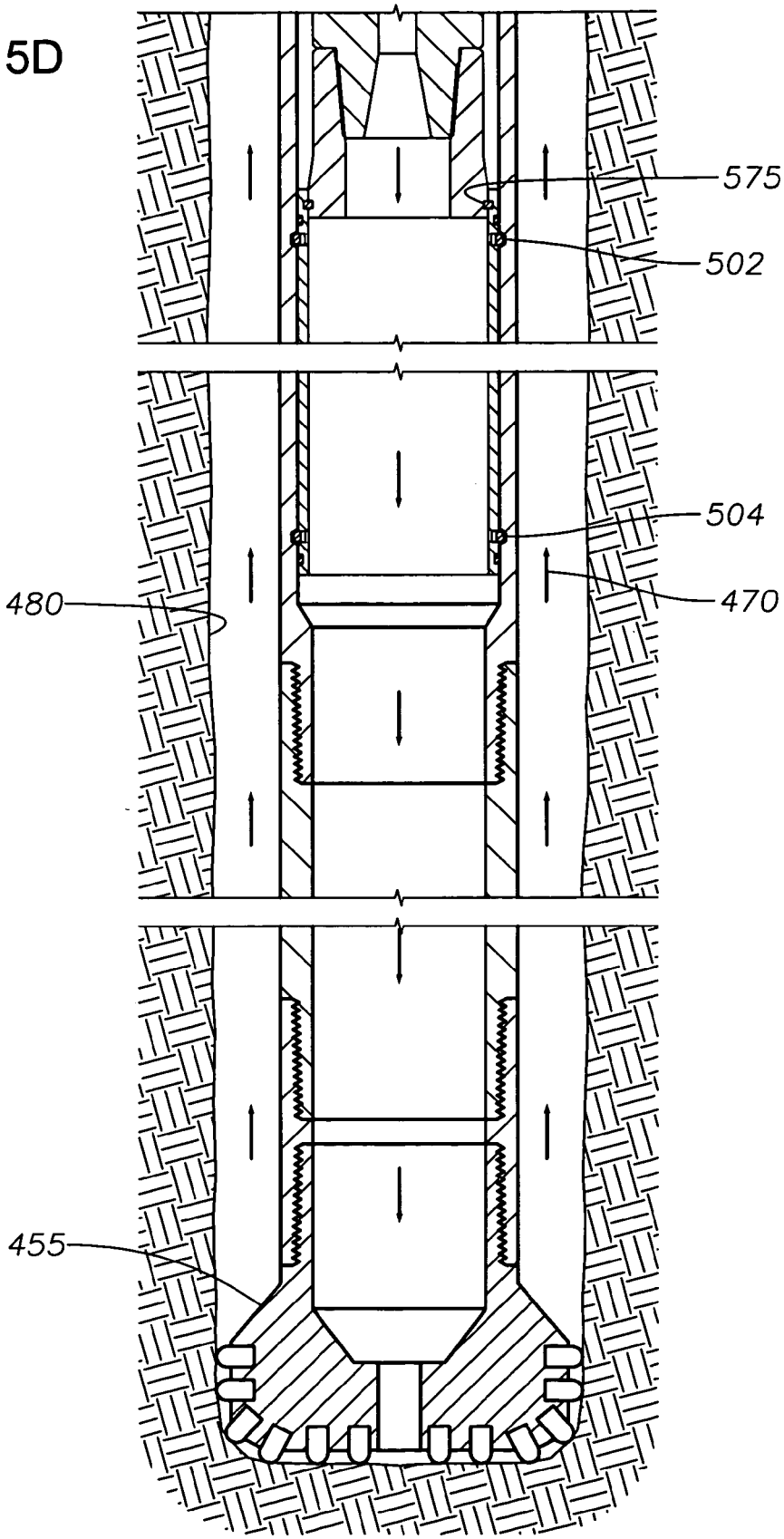

FIG. 4 is a section view showing the impeller/pump portion completely removed and the sleeve remaining in the interior of the sub. With the impeller/pump portion of the assembly retrieved to the surface of the well and the sleeve covering the pocket and preventing fluid communication between the exterior and interior of the casing, the casing may be cemented in the wellbore in a conventional manner.

In another aspect, the invention can be used in a manner that provides selective use of the energy transfer assembly 100 at any time while drilling with casing. For example, the sub with its annular pocket 170 can be provided in a casing string along with a sleeve, which in the run-in position, isolates the interior of the casing from the fluid in the annulus. At some predetermined time, the energy transfer assembly including the impeller and pump blades can be run into the wellbore and landed in the sub in a manner in which its installation shifts the sleeve to a lower position, thereby providing fluid communication between the annulus and the pump blades via the ports 175, 180. In this instance, the energy transfer assembly can be operated at some pre-selected time and later removed from the wellbore. For example if, during the drilling of a borehole with casing, a thief zone is encountered where well bore fluid is being lost to a formation adjacent the borehole, the energy transfer assembly can be installed in the wellbore and operated to add energy to fluid in the annulus and reduce the tendency of the fluid to flow into an adjacent formation. This alternative arrangement and others are within the purview of this invention.

In another specific embodiment, a pump and motor are each disposed completely within the casing and are removable therefrom. FIGS. 5A, 5B, 5C and 50 are section views of a motor 300 and a pump 400 disposed in a housing that is run in a string of casing. The motor 300 is of the type disclosed in Publication No. PCT/GB99/02450 incorporated by reference herein in its entirety, with fluid directed inwards with nozzles to contact bucket-shaped members and cause a rotor portion of a shaft to turn. The pump 400 disposed in the casing below the motor, includes an impeller section 425 that has outwardly formed undulations 430 formed on an outer surface of a rotor portion 435 of the pump shaft and mating, inwardly formed undulations 440 on an interior of a stator portion 445 of the pump housing 420 therearound.

The motor and pump assembly of FIGS. 5A–5D is constructed and arranged to be entirely housed within the string of casing 405 and is typically disposed in the casing string in a separate sub 405 which is connected in the string. The sub includes a fluid a path for fluid through the assembly towards the drill bit formed at the lower end of the casing string. The path of the fluid is shown with arrows 450 as it travels through the motor 300 and down to the bit 455. Return fluid from the annulus is directed into the assembly through ports 460, 465 provided at a lower end thereof. After entering the ports, the fluid travels in annular fashion where it is acted upon by the pump portion and energy is added thereto. The path of the return fluid is shown by arrows 470. After leaving the pump, the fluid travels back into the annulus defined between the borehole 480 and the casing string. Another pair of ports 485, 490 provides a path for the returning fluid. The ports 460, 465, 485, 490 are sealed with bridge type seals 466 at an upper and lower ends thereof.

The assembly of FIGS. 5A–5D is also completely removable and includes an upper 502 and lower 504 latch assemblies that are disengageable with the application of an upwards force as described in previous embodiments. Additionally, like previously described embodiments, the assembly includes a sleeve member 510 constructed and arranged to remain in the interior of the sub to seal the ports 460, 465, 485, 490 after the assembly has been removed. Specifically, a shearable connection 575 between the motor/pump portions and the sleeve is caused to fail after the sleeve has assumed a second position whereby it covers the upper and lower ports. Additionally, a recessed area having a shoulder 520 at an upper end thereof permits the sleeve to remain in the interior of the sub while maximizing the inside diameter of the sub for the passage of cement and tools.

While the embodiment has been described with a fluid powered motor, the energy transfer assembly could also operate with a motor powered by other means, like electricity. In the case of an electric motor, a source of electricity can be provided by a conductor extending from the surface of the well or even by the casing itself if it is equipped to provide electrical power as in the case of wired pipe. Wired pipe and its uses are described in co-pending application Ser. No. 09/976,845, filed 12 Oct. 2001, and that specification is incorporated herein.

In yet another embodiment of the invention, the energy transfer device used to add energy to fluid circulating upwards in the annulus defined between a casing string and a borehole is a jet device which is run into the well entirely within the casing string. The principles of venturi-type jet are well known in the art and an example of a jet device used to reduce ECD is illustrated in FIG. 4 of copending application Ser. No. 10/156,722 which has been incorporated by reference herein. The jet device typically includes some type of restriction placable in the bore of the casing string which causes a back pressure of fluid traveling downwards in the casing. The back pressure causes a portion of the fluid to travel through openings that are provided in a wall of the casing and that fluid is directed through nozzles leading into the annular area defined between the casing string and the borehole. The remainder of the fluid continues downwards to the drill bit.

The nozzle typically includes an orifice and a diffuser portion. The geometry and design of the nozzle creates a low pressure area near and around the end of each nozzle. Because of fluid communication between the low pressure area and the annulus, some fluid below the nozzle is urged upward due to pressure differential. In this manner, energy is added to the fluid returning to the surface of the well and ECD is reduced. As with other embodiments described herein, the jet device is completely removable from the casing string after the borehole is formed by drilling with casing. Typically, like the other embodiments, the jet device, with its restriction is temporarily held within the interior of the casing by a latch assembly. An inwardly formed profile within the assembly is attachable to a run-in tool and upward force causes the latch assembly to become disengaged, permitting the jet device to be removed. Also, like other embodiments herein, a sleeve can be attached to a lower end of the jet device using a shearable connection which permits the sleeve to move upwards to a second position whereby it covers apertures that provided fluid communication between the inside and outside of the casing. With the sleeve in the second position covering the apertures, the shearable connection is caused to fail and the casing can be cemented in the borehole in a conventional manner.

As described and illustrated by the foregoing, the present invention provides an apparatus and methods to reduce ECD while drilling with casing in a manner that leaves the casing ready to be cemented in the wellbore. While the energy transfer assembly has been described according to a preferred design, the invention can be practiced with any type of assembly that uses a fluid traveling in one direction to act upon a flow of fluid traveling in an opposite direction.

The invention claimed is:

1. An energy transfer assembly for use while lowering a casing in a wellbore, comprising:

a motor portion operatively connected to the casing, the motor portion rotatable by fluid traveling in the casing, the motor portion having an impeller;

a pump section operatively connected to the motor portion and in fluid communication with an annulus of the wellbore, the pump section having at least one blade and constructed and arranged to rotate in response to rotation of the motor portion to add energy to fluid traveling in the annulus; and a housing for the at least one blade, the housing extending at least partially into the annulus and having at least one port for the entry of fluid from the annulus and one port for the exit thereof.

2. The energy transfer assembly of claim 1 wherein at least a portion of the energy transfer assembly is selectively removable from the casing.

3. The energy transfer assembly of claim 1, wherein the motor portion is removable from the casing.

4. The energy transfer assembly of claim 3, further comprising a sleeve member, the sleeve member shiftable from a first position to a second position in the casing, wherein, in the second position, the sleeve member is adapted to isolate the interior of the casing from the annulus.

5. The energy transfer assembly of claim 4, wherein the sleeve member is shifted to the second position during removal of the motor portion.

6. The energy transfer assembly of claim 1, further comprising a sleeve member, the sleeve member shiftable from a first position to a second position in the casing, wherein, in the second position, the sleeve member is adapted to isolate the interior of the casing from the annulus.

7. The energy transfer assembly of claim 1, further comprising a drilling member disposed at a lower portion of the casing.

8. The energy transfer assembly of claim 7, wherein at least a portion of fluid traveling in the casing exits through the drilling member.

9. The energy transfer assembly of claim 1, wherein the pump section comprises an annular chamber in fluid communication with the wellbore.

10. A removable energy transfer assembly for use in a tubular string run-in to a wellbore comprising:

a motor portion and a pump portion, the motor portion in fluid communication with fluid in the tubular string and the pump portion in fluid communication with fluid in an annulus;

at least one latch assembly temporarily holding at least a portion of the assembly in an interior of the tubular string, the latch assembly being selectively disengageable;

an isolating member axially movable in the tubular to seal the tubular string as the energy transfer assembly is removed.

11. The energy transfer assembly of claim 10, wherein the pump portion comprises a fluid urging member adapted to add energy to the fluid traveling in the annulus.

12. The energy transfer assembly of claim 11, wherein the fluid urging member is adapted to allow removal of the motor portion from the tubular string.

13. The energy transfer assembly of claim 10, wherein the isolating member comprises a sleeve member shiftable from a first position to a second position in the tubular string, wherein, in the second position, the sleeve member is adapted to isolate the interior of the tubular string from the annulus.

14. The energy transfer assembly of claim 13, wherein the sleeve member is shifted to the second position during removal of the energy transfer assembly.

15. The energy transfer assembly of claim 10, further comprising a drilling member disposed at a lower portion of the tubular string.

16. The energy transfer assembly of claim 15, wherein at least a portion of fluid traveling in the tubular string exits through the drilling member.

17. The energy transfer assembly of claim 12, wherein the fluid urging member comprises a blade.

18. A drilling assembly for forming a wellbore, comprising:

a casing having a drilling member disposed at a lower portion thereof;

an energy transfer assembly coupled to the casing, the energy transfer assembly having:

a motor portion in fluid communication with fluid in the casing; and a pump portion in fluid communication with fluid in an annular area between the casing and the wellbore, wherein the energy transfer assembly is adapted to transfer energy from fluid traveling in the casing to fluid traveling in the annular area.

19. The drilling assembly of claim 18, wherein the pump portion comprises an energy transfer member, wherein energy transfer member is activated by the motor portion.

20. The drilling assembly of claim 19, wherein the energy transfer member comprises a blade.

21. An energy transfer assembly for use while lowering a casing in a wellbore, comprising:

motor portion operatively connected to the casing, the motor portion rotatable by fluid traveling in the casing;

a pump section operatively connected to the motor portion and in fluid communication with an annulus of the wellbore, the pump section constructed and arranged to rotate in response to rotation of the motor portion to add energy to fluid traveling in the annulus; and a sleeve member, the sleeve member shiftable from a first position to a second position in the casing, wherein, in the second position, the sleeve member is adapted to isolate the interior of the casing from the annulus.

22. The energy transfer assembly of claim 21, wherein the sleeve member is shifted to the second position during removal of the motor portion.

23. The energy transfer assembly of claim 21, wherein the motor portion is removable from the casing.

24. The energy transfer assembly of claim 23, wherein the sleeve member is disconnected from the motor portion during removal of the motor portion.

25. An energy transfer assembly for use while lowering a casing in a wellbore, comprising:

motor portion operatively connected to the casing, the motor portion rotatable by fluid traveling in the casing;

a pump section operatively connected to the motor portion and in fluid communication with an annulus of the wellbore, the pump section constructed and arranged to rotate in response to rotation of the motor portion to add energy to fluid traveling in the annulus; and a drilling member disposed at a lower portion of the casing.

26. The energy transfer assembly of claim 25, wherein the motor portion is removable from the casing.

27. The energy transfer assembly of claim 25 further comprising a sleeve member, the sleeve member shiftable from a first position to a second position in the casing, wherein, in the second position, the sleeve member is adapted to isolate the interior of the casing from the annulus.

28. The energy transfer assembly of claim 27, wherein the sleeve member is shifted to the second position during removal of the motor portion.

29. The energy transfer assembly of claim 25 wherein at least a portion of fluid traveling in the casing exits through the drilling member.

30. A method of lowering a casing assembly in a wellbore, comprising:

providing the casing assembly with:

a casing;

a drilling member disposed at a lower portion of the casing;

an energy transfer assembly having:

a motor portion in fluid communication with an interior of the casing; and a pump portion in fluid communication with an annular area between the casing and the wellbore, wherein the energy transfer assembly is adapted to transfer energy from fluid traveling in the casing to fluid traveling in the annular area;

supplying fluid in the casing to activate the motor portion;

rotating the drilling member; and adding energy to fluid traveling in the annular area.

31. The method of claim 20, further comprising removing at least a portion of the energy transfer assembly.

32. The method of claim 31, further composing providing a sleeve for preventing fluid communication between the interior of the casing and the annular area when the portion of the energy transfer assembly is removed.

33. The method of claim 20, further comprising cementing the casing in the wellbore.

* * * * *

UNITED STATES PATENT AND TRADEMARK OFFICE

CERTIFICATE OF CORRECTION

PATENT NO. : 7,090,023 B2
APPLICATION NO. : 11/124755
DATED : August 15, 2006
INVENTOR(S) : David M. Haugen and Frederick T. Tilton It is certified that error appears in the above-identified patent and that said Letters Patent is hereby corrected as shown below:

On the front page:

In the first column, under "( * ) Notice", please delete the second paragraph: "This patent is subject to a terminal disclaimer."

In the Claims section:

In column 10, Claim 32, line 28, please delete "composing" and insert --comprising--.

Signed and Sealed this

Twenty-seventh Day of March, 2007

JON W. DUDAS
*Director of the United States Patent and Trademark Office*